US005409153A

United States Patent [19]

Ristich

[11] Patent Number: 5,409,153

[45] Date of Patent: Apr. 25, 1995

[54] MENS PURSE

[76] Inventor: George Ristich, 743 Promontory Dr. West, Newport Beach, Calif. 92663

[21] Appl. No.: 151,936

[22] Filed: Nov. 15, 1993

[51] Int. Cl.[6] ..... A45F 5/00

[52] U.S. Cl. ..... 224/253; 224/236; 224/241; 224/227; 150/112; 150/114; 150/117; 190/112; 190/114

[58] Field of Search ..... 224/191, 199, 253, 223, 224/235, 236, 241, 242, 192, 193, 198, 227, 911; 150/112, 114, 117; 190/112, 114

[56] References Cited

U.S. PATENT DOCUMENTS

| | | | |
|---|---|---|---|
| D. 84,841 | 8/1931 | Mordt | D3/44 |
| D. 251,574 | 4/1979 | Molinari et al. | D3/44 |
| 1,054,331 | 2/1913 | Batchelder | 224/253 |
| 1,648,565 | 11/1927 | Primley | 224/253 |
| 2,063,850 | 12/1936 | Nemeth et al. | 150/28 |
| 2,076,654 | 4/1937 | Lewis | 292/137 |
| 2,324,194 | 7/1943 | Campiglia | 224/236 |
| 2,413,465 | 12/1946 | Ohlsen | 150/117 |
| 2,533,850 | 12/1950 | Syracuse | 150/34 |
| 2,983,412 | 5/1961 | Ferguson | 224/253 |
| 4,303,187 | 12/1981 | Berman | 224/222 |
| 4,512,504 | 4/1985 | Owlett | 224/42.46 R |
| 4,515,300 | 5/1985 | Cohen | 224/253 |
| 4,779,655 | 10/1988 | Olson | 150/134 |
| 4,796,790 | 1/1989 | Hamilton | 224/253 |
| 4,801,059 | 1/1989 | Hayes | 224/240 |
| 5,170,919 | 12/1992 | DeSantis et al. | 224/192 |
| 5,294,031 | 3/1994 | Volpei et al. | 224/911 |

OTHER PUBLICATIONS

Gershman, Self-Adhering Nylon Tapes, Oct. 18, 1958, Journal of A.M.A., vol. 168, No. 7, p. 930.

*Primary Examiner*—Henry J. Recla
*Assistant Examiner*—Steven O. Douglas
*Attorney, Agent, or Firm*—Harold L. Jackson

[57] ABSTRACT

A men's purse is disclosed which is typically carried on a waist belt along the leg of the carrier. The men's purse includes a rear oblong compartment and a slim front compartment. The rear compartment has a zipped top opening for gaining access therein and the slim front compartment is formed by a flap which is zippered to the rear compartment. If the flap zipper is opened, the flap may be swung open to gain access to contents stored within the slim compartment.

24 Claims, 2 Drawing Sheets

MENS PURSE

BACKGROUND OF THE INVENTION

1. Field of the Invention

The invention relates generally to carrying bags for carrying a variety of accessories and more particularly to men's purses.

2. Description of Related Art

Carrying bags have evolved over the years of various types, shapes, sizes and textures for different purposes and uses to transport large or small items whether heavy or light. One conventional carrying bag is the lady's handbag or purse which have been primarily used to transport small personal accessories such as cosmetics, sunglasses, wallets and many other items. Typically, lady's handbags comprise an oblong-shaped bag made of a leather or synthetic material, which may include a number of interior or exterior pockets and a strap for carrying the handbag in one's hand or over one's shoulder. U.S. Pat. Nos. 2,063,850; 2,533,850, and Des. 251,574 disclose a few examples of lady's handbags that have been developed over the years. U.S. Pat. No. 2,063,850 issued to Syracuse discloses a lady's handbag having two pockets accessible through zippers on the top of the handbag, and two end pockets accessible through longitudinally disposed side zippers. This handbag is designed to carry diapers, bottles and other desired items for the care of an infant while traveling or away from home. In U.S. Pat. No. 2,533,850 issued to Lewis another lady's handbag is disclosed having two flat body portions with circumscribing metal frames which are hinged together, the flat body portions having a number of interior pockets. The flat body portions may be closed together by a latch arrangement on the metal frame. Nemuth et al. in U.S. Pat. No. 2,063,850 disclose a lady's handbag made in a U-shaped structure wherein two separate top zippered pockets are folded into a side by side arrangement. U.S. Pat. No. Des. 251,574 issued to Molinari et al. discloses a handbag made in the shape of a tennis shoe with a zipped pocket along the top thereof.

Carrying bags have also been developed for transporting items associated with special activities such as shopping, work and sports activities. For example, Ferguson, in U.S. Pat. No. 2,983,412 discloses a belt purse for a shopper having a zippered top pocket and several overlaid open pouch-type pockets. The pockets are accessible from the top side of the purse. Owlett in U.S. Pat. No. 4,512,504 discloses a shopping organizer comprising a one piece backing sheet foldable into upper, middle and bottom sections with a flap that wraps around the handle of a market basket. The organizer includes a sleeve for retaining a pen, a clip for retaining papers, and various pockets for storing coupons, shopping lists, calculators and other items. A pocket calculator holder useful for school or work is disclosed in U.S. Pat. No. 4,801,059 issued to Hayes which includes a holder body having a front portion and a back portion attached to form a pocket having a closed bottom, closed sides, and an open top. The holder can be secured to a waist belt or a shoulder strap. As to sports activity bags, one example is shown in Primley, U.S. Pat. No. 1,648,565 which discloses a golf ball carrier including a large open pocket for carrying at least a dozen golf balls, with other smaller pockets therein for carrying pens, golf rule book, extra score cards and other golf related items.

More recently, men have also taken to carrying purses which provide more accessory capacity than a traditional men's folded back pocket wallet. Such men's purses are hand carried and include a large bag zippered on top, which zipper opens to access items within the bag. Another men's accessory wallet is disclosed in U.S. Pat. No. 4,779,655 issued to Olson which is adapted for fitting over the waistband of trousers. The wallet comprises three adjacent pliable fabric panels with pockets therein which panels are affixed together at their top edges to permit the wallet to straddle the waistband of an article of clothing. Another clothing accessory wallet is disclosed in Berman, U.S. Pat. No. 4,303,187 which includes a base panel, the upper portion having a pair of belt loops through which a wearer passes their belt thereby securing the wallet to his trousers. The lower portion includes a tie string which the wearer ties around his thigh, and the intermediate portion includes closeable and open pockets.

However, a convenient easily manipulated men's purse is still needed and would provide an advancement in the art.

SUMMARY OF THE INVENTION

It is therefore an object of the invention to provide a purse that is easy and convenient to carry without the need to carry it in one's hand.

It is another object of the invention to provide a purse that can be opened and accessed with one hand.

It is still a further object of the invention to provide a purse that is of simple yet reliable construction.

A men's purse according to the present invention includes a boxed-shaped compartment and a flap hinged to this compartment which together have a cooperative closure means for securing the flap to the box-shaped compartment forming a slim compartment therebetween. The box-shaped compartment may have a loop attached thereto for attaching the purse to a belt. Further, the box-shaped compartment may have a tie string secured thereto which can be tied around the leg of a carrier to provide stability when carried.

DESCRIPTION OF THE PREFERRED EMBODIMENT

Figure 1:
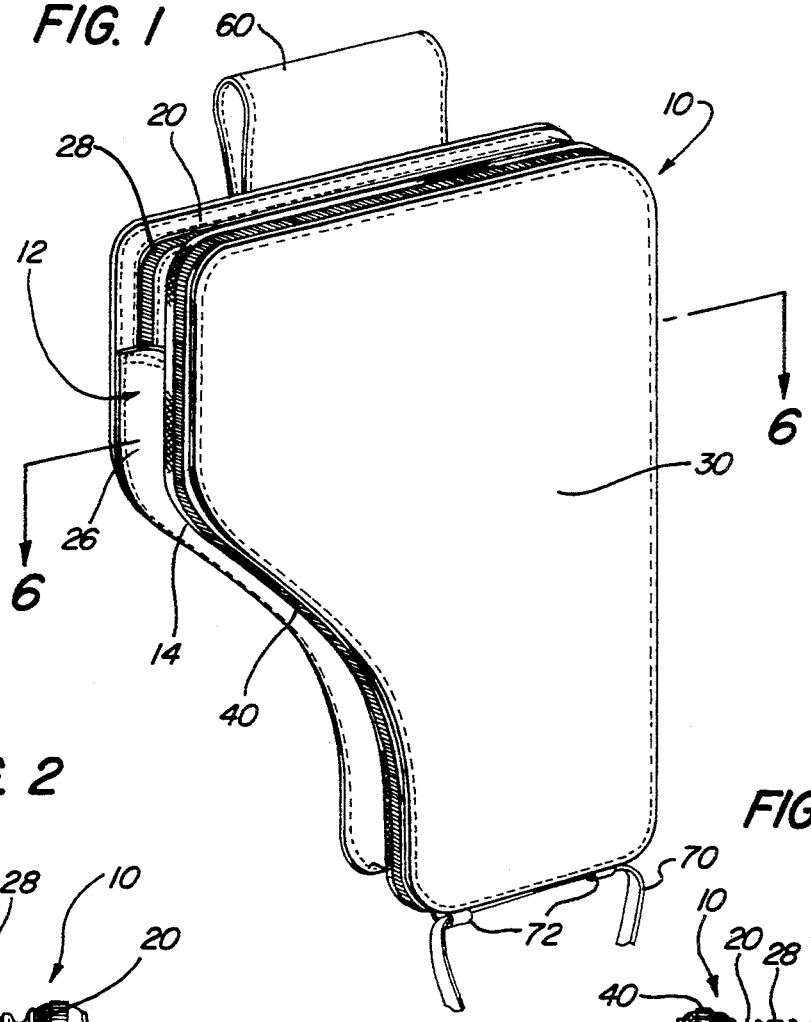
FIG. 1 is a perspective view of a purse according to the principles of the invention.

Referring now with more particularity to the drawings, wherein like or similar parts are designated by the same or primed numerals throughout the various figures, a purse structure 10 according to the principles of the present invention is illustrated in FIGS. 1–6 which comprises two major compartments, a first compartment 12 and a second compartment 14. The first compartment 12 is holster-shaped bag defined by back panel 16, front panel 18, top panel 20, bottom panel 22, forward facing side panel 24, and rear facing side panel 26. The front panel 18 has an overall extent similar to the back panel 16 to which it is matched via the two side, top and bottom panels affixed therebetween to form the first compartment 12. A top zipper 28 extends along the extent of the top panel 20 laterally across the top of the purse 10 and down a short distance into the two side panels 24 and 26. The top zipper 28 provides access into the first compartment 12 through the top panel for retrieving or placing accessories within this compartment. In this particular embodiment, the first compartment is generally rectangularly shaped with a wider top section (at panel 20) and a narrower bottom section (at panel 22) having an elongated extent with a longitudinal axis 29.

A flap 30 is attached to the first compartment 12 and folds over the front panel 18 to form the second compartment 14. Flap 30 has an overall extent similar to the front panel 18 to which it is matched. By means of coupling hinge 32, flap 30 is attached to the front corner 34 formed by the interface of the front panel 18 with front side panel 24. Accordingly, the coupling hinge 32 extends along the direction of the longitudinal axis 29 and the flap 30 swings along the longitudinal axis of the purse 10. The coupling hinge 32 provides a hinge mechanism which allows flap 30 to swing adjacent to the front panel 18 to provide second compartment 14 as shown with more particulatity in FIG. 6; or alternatively to swing away from front panel 18 to provide access to the front panel exterior surface 36 and flap interior surface 38, as shown with more particularity in FIG. 5. Second compartment 14 is formed by closing periphery zipper 40 which extends along the outer peripheral edge of front panel 18 and cooperatively along the outer peripheral edge of flap 30, on three sides thereof and into a portion of the side where the flap 30 is attached by coupling hinge 32. Accordingly, when the peripheral zipper 40 is fully open, flap 30 may be fully swung open along the coupling hinge 32. When the peripheral zipper 40 is zipped closed, the flap interior surface 38 sits adjacent to the front panel exterior surface 36 with, for the most part, a slim separation therebetween.

Figure 5:
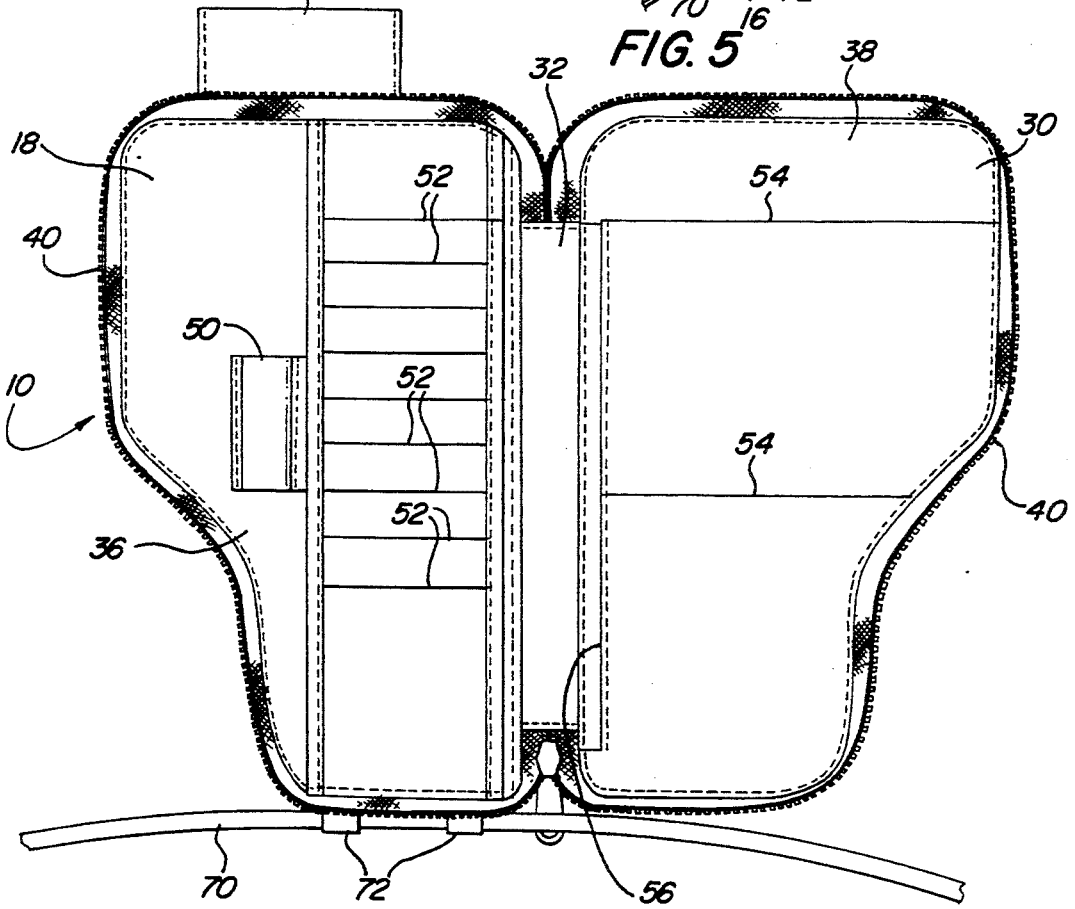
FIG. 5 is a front view of the purse of FIG. 1 showing the flap in its open position.
Figure 6:
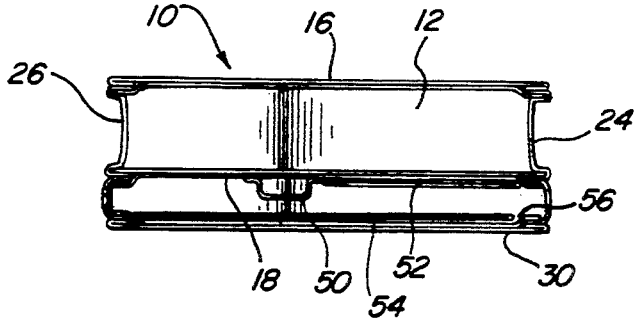
FIG. 6 is a cross-sectional view of the purse of FIG. 1 taken along line 6—6.

In order to make the purse more versatile, the first and second compartments may have pockets therein or the exterior of the purse may have pockets thereon. For example, the exterior surface 36 of the front panel 18 could have a plurality of pockets therein for holding various accessories, such as sleeve 50 for holding a pen and pockets 52 for carrying credit cards, as shown in FIG. 5. The interior surface 38 of flap 30 could also have an assortment of pockets for carrying various items, three pockets being shown in this example, namely: two horizontally opening pockets 54 and one vertically opening pocket 56.

Figure 2:
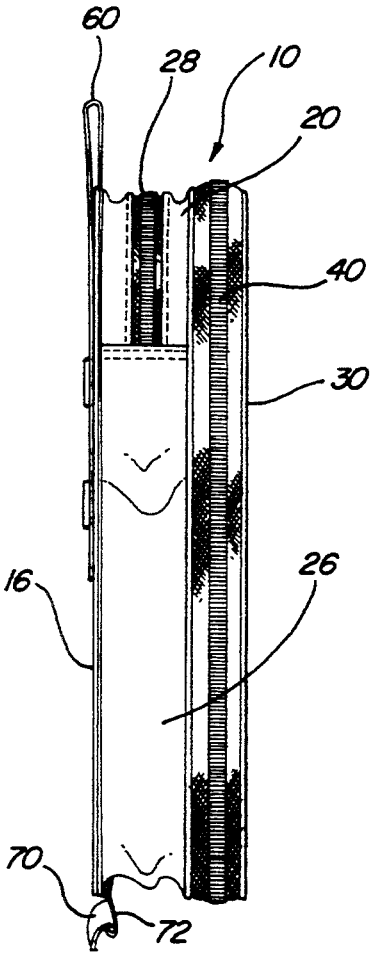
FIG. 2 is a rear side view of the purse of FIG. 1.
Figure 3:
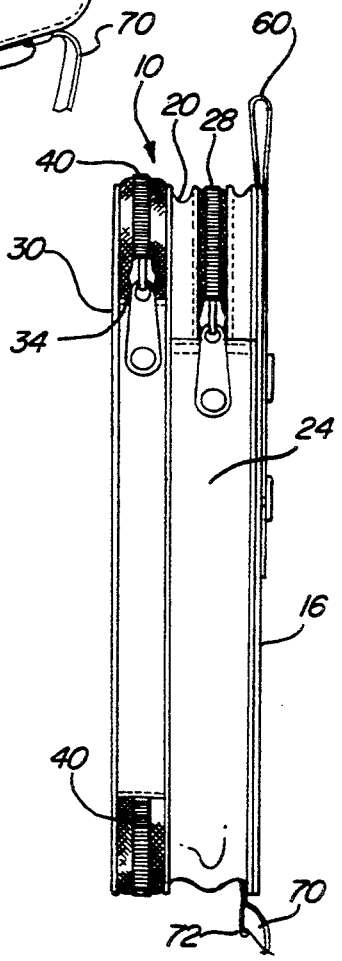
FIG. 3 is a front side view of the purse of FIG. 1.
Figure 4:
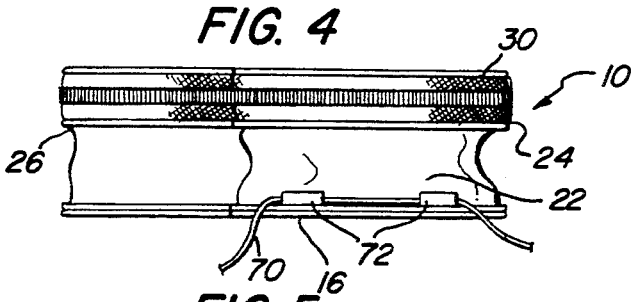
FIG. 4 is a bottom side view of the purse of FIG. 1.

While the afore-described purse can be carried in one's hand, for more convenience, means may be provided for carrying the purse on one's person. For example, purse 10 may have an belt attachment arrangement for carrying it on the belt along the waist of a carrier. More specifically, the back panel 16 may have a loop 60 secured thereto which extends upwardly above the top panel 20, as shown in FIGS. 1–3. A belt is passed through the loop 60 and the purse 10 sits on the side thigh area of the bearer. The belt attachment arrangement could also be a clip or hook mechanism, for example. To keep the purse 10 from flopping while the carrier is walking, it may be secured to the carrier's leg. For example, a tie string 70 may be attached through loops 72 attached to the bottom of the back panel 16. The tie string 70 may be wrapped around a carrier's leg and tied thereto to provide more stability whenever desired. Advantageously, the purse carried on a belt allows the flap to open along the longitudinal axis of the carrier's leg. The zipper can easily be manipulated by one hand of the carrier and the flap opened such that the pockets in the second compartment easily accessed.

The shape of purse 10 in this particular embodiment is oblong having a wider top portion which tapers about the middle portion to a narrower bottom portion. The resulting holster-shaped purse provides a long interior compartment wherein an oblong object such as a hand held cellular phone can be stowed in an upright position for easy access thereto. The purse preferably is constructed using leather material and threaded seams, while it can also be made from other materials, such as synthetic materials which may be vinyl. Furthermore, the zippers described for the closing mechanisms of the first and second compartment may be provided by other means such as Velcro or snaps, for example.

The above-described detailed description of a preferred embodiment described the best mode contemplated by the inventor for carrying out the present invention at the time this application was filed and is offered by way of example and not by way of limitation. Various modification may be made to the above-described preferred embodiment without departing from the scope of the invention. Accordingly, it should be understood that although the invention has been described and shown for a particular embodiment, nevertheless various changes and modifications obvious to a person of ordinary skill in the art to which the invention pertains are deemed to lie within the spirit and scope of the invention as set forth in the following claims.

What is claimed is:

1. A purse having a longitudinal axis and adapted to be carried so that the longitudinal axis is vertically oriented, comprising:

a first compartment having front and back panels, two opposite side panels and top and bottom panels; the top panel having a closeable opening therein, said first compartment front panel having a front major surface and a circumscribing peripheral extent;

a flap of similar size to the front panel front major surface of said compartment, said flap being hinged to said compartment along a line parallel to the longitudinal axis and having a circumscribing peripheral extent, and closure means along the circumscribing peripheral extent on said flap and first compartment having a closed position for securing said flap to the front major surface establishing a second compartment therebetween, and having an open position allowing the flap to swing away from the front major surface.

2. The purse defined in claim 1 wherein said compartment is formed having the top panel wider than the bottom panel.

3. The purse defined in claim 2 wherein said closure means is a zipper.

4. The purse defined in claim 3 further comprising a tie string for strapping the purse to a leg.

5. The purse defined in claim 2 further comprising attachment means for suspending said purse from a belt.

6. The purse defined in claim 5 wherein said closure means comprises Velcro.

7. A holster style purse to be carried on the belt and tied to the leg of a bearer, comprising:

an oblong block-shaped compartment having a longitudinal axis; said compartment having a top panel with a zippered opening;

a flap disposed over the oblong block-shaped compartment;

a hinge coupling the flap to the oblong block-shaped compartments, said hinge disposed along the direction of said longitudinal axis such that said flap opens and closes along the longitudinal axis;

a closure mechanism to secure said flap to said oblong block-shaped compartment forming another compartment;

means for attaching the oblong block-shaped compartment to a belt such that said oblong block-shaped compartment will sit along the leg of the bearer in the direction of the longitudinal axis, and means for securing said oblong block-shaped compartment to the leg of the bearer.

8. The purse defined in claim 7 wherein said closure mechanism comprises a zipper along the outer periphery of the flap and oblong compartment.

9. The purse defined in claim 7 wherein said attaching means comprises a loop member attached along the longitudinal axis.

10. The purse defined in claim 7 wherein said securing means comprises a string attached to the oblong compartment.

11. The purse defined in claim 7 wherein said oblong compartment has a zippered closure means for gaining access to said compartment.

12. A purse comprising:

an oblong block-shaped compartment having front and back panels, two opposite side panels and top and bottom panels, the top panel having a closeable opening therein and the front panel having a circumscribing peripheral extent;

a flap attached to said oblong block-shaped compartment and extendible over the front panel, said flap having a circumscribing peripheral extent;

a zipper along the peripheral extent of the front panel and flap for securing the flap adjacent to the front panel;

belt attachment means for attaching the purse to a belt, and a string attached to the oblong block-shaped compartment for securing the purse to a leg.

13. The purse defined in claim 12 wherein the closeable opening comprises a zipper.

14. The purse defined in claim 12 wherein the front panel has at least one pocket therein.

15. The purse defined in claim 12 wherein the flap has at least one pocket therein.

16. The purse defined in claim 12 wherein the top panel is wider than the bottom panel.

17. A purse comprising:

an oblong block-shaped compartment having front and back panels, two opposite side panels and top and bottom panels, the top panel having a closeable opening therein and the front panel having a circumscribing peripheral extent;

a flap attached to said oblong block-shaped compartment and extendible over the front panel, having at least one pocket therein and a circumscribing peripheral extent, and a zipper along the circumscribing peripheral extent of the front panel and flap for securing the flap adjacent to the front panel.

18. The purse defined in claim 17 wherein the closeable opening comprises a zipper.

19. The purse defined in claim 17 further comprising belt attachment means for attaching the purse to a belt.

20. The purse defined in claim 17 further comprising a string attached to the oblong block-shaped compartment for securing the purse to a leg.

21. The purse defined in claim 17 wherein the front panel has at least one pocket therein.

22. A purse for carrying a variety of accessories which purse is suspended from a belt, comprising:

two adjacent compartments separated by a panel member therebetween, one compartment substantially thinner than the other compartment, said one compartment having a flap panel member which opens to expose the interior thereof;

zipper means for providing access to the other compartment;

means for suspending the purse from a belt, and a string attached to the other compartment for tying the other compartment to a leg.

23. The purse defined in claim 22 wherein the panel member is flat.

24. The purse defined in claim 22 wherein the purse suspending means comprises a loop member.

* * * * *